US012758077B2

(12) United States Patent
Zhuang et al.

(10) Patent No.: US 12,758,077 B2
(45) Date of Patent: Oct. 13, 2026

(54) CLEAN WATER AND WASTEWATER SEPARATING MOP BUCKET

(71) Applicant: Ping Zhuang, Futian (CN)

(72) Inventors: Ping Zhuang, Futian (CN); Tingzhao Yuan, Futian (CN)

(73) Assignee: Ping Zhuang, Shenzhen (CN)

( * ) Notice: Subject to any disclaimer, the term of this patent is extended or adjusted under 35 U.S.C. 154(b) by 316 days.

(21) Appl. No.: 18/596,932

(22) Filed: Mar. 6, 2024

(65) Prior Publication Data

US 2025/0072702 A1 Mar. 6, 2025

Related U.S. Application Data

(63) Continuation-in-part of application No. 18/461,935, filed on Sep. 6, 2023, now Pat. No. 11,950,738.

(51) Int. Cl.
*A47L 13/58* (2006.01)

(52) U.S. Cl.
CPC ..... *A47L 13/58* (2013.01)

(58) Field of Classification Search
CPC ..... A47L 13/58–60
USPC ..... 15/260, 263
See application file for complete search history.

(56) References Cited

U.S. PATENT DOCUMENTS

| | | | | |
|---|---|---|---|---|
| 6,279,195 | B1 * | 8/2001 | Biggs | A47L 13/59 15/264 |
| 10,238,263 | B2 | 3/2019 | Huang | |
| 2005/0076465 | A1 * | 4/2005 | Rousey | A47L 13/58 15/264 |
| 2012/0047675 | A1 | 3/2012 | Chu | |
| 2017/0065144 | A1 * | 3/2017 | Huang | A47L 13/58 |
| 2018/0279849 | A1 | 10/2018 | Dingert | |
| 2024/0032768 | A1 * | 2/2024 | Vallar | A47L 13/51 |

FOREIGN PATENT DOCUMENTS

| | | | |
|---|---|---|---|
| CN | 106473684 | A | 3/2017 |
| CN | 106993991 | A | 8/2017 |
| CN | 109984696 | A | 7/2019 |
| CN | 111214190 | A | 6/2020 |
| CN | 112493953 | A | 3/2021 |
| CN | 212755536 | U | 3/2021 |
| CN | 215305618 | U | 12/2021 |
| CN | 115137269 | A | 10/2022 |
| CN | 218045025 | U | 12/2022 |
| CN | 219538198 | U | 8/2023 |
| DE | 202021100668 | U1 | 4/2021 |
| WO | 2019025645 | A1 | 2/2019 |
| WO | 2021029841 | A1 | 2/2021 |
| WO | 2022039685 | A1 | 2/2022 |

* cited by examiner

*Primary Examiner* — Tom Rodgers

(57) ABSTRACT

Provided is a clean water and wastewater separating mop bucket, including: a lower bucket body and an upper bucket body movably disposed in the lower bucket body; wherein the lower bucket body comprises a clean water container and a sewage container that are independent of each other and are blocked from each other, and the upper bucket is provided with a drain port communicated with the sewage container; a water guide pipe, connecting the clean water container and the upper bucket body; wherein the water guide pipe comprises a water inlet pipe at least partly received in the clean water container and a water outlet pipe that is not directly connected to the water inlet pipe; and a water pump device, connected to the water guide pipe.

5 Claims, 6 Drawing Sheets

CLEAN WATER AND WASTEWATER SEPARATING MOP BUCKET

CROSS REFERENCE

This application is a continuation-in-part of U.S. patent application Ser. No. 18/461,935, filed on Sep. 6, 2023, which is a continuation-application of International (PCT) Patent Application No. PCT/CN2023/073692, filed on Jan. 29, 2023, which claims priority of Chinese Patent Application No. 202210963942.4, filed on Aug. 11, 2022, and Chinese Patent Application No. 202310037670. X, filed on Jan. 9, 2023, the entire contents of which are hereby incorporated by reference in their entirety.

TECHNICAL FIELD

The present disclosure relates to the technical field of daily living goods, and in particular to a clean water and wastewater separating mop bucket.

BACKGROUND

Spin mop is a common cleaning tool in daily life, which is usually used with a mop bucket, with the advantages of easy to clean and dry.

A conventional mop bucket includes a cleaning container for cleaning the mop and a drying container for drying the mop. The mop is rotated in the cleaning container for rinsing, and then rotated in the drying container for drying, with the water thrown out being taken over by the cleaning container. However, for such the mop bucket in the process of cleaning the used mop, as long as the water is not changed, the water in the cleaning container is bound to get dirtier and dirtier, resulting in poor cleaning results and secondary pollution.

SUMMARY OF THE DISCLOSURE

Based on above, it is necessary to propose a clean water and wastewater separating mop bucket to ensure that the mop is cleaned with clean water every time.

A clean water and wastewater separating mop bucket, including: a lower bucket body and an upper bucket body movably disposed in the lower bucket body; wherein the lower bucket body comprises a clean water container and a sewage container that are independent of each other and are blocked from each other, and the upper bucket is provided with a drain port communicated with the sewage container; a water guide pipe, connecting the clean water container and the upper bucket body; wherein the water guide pipe comprises a water inlet pipe at least partly received in the clean water container and a water outlet pipe that is not directly connected to the water inlet pipe; and a water pump device, connected to the water guide pipe.

In some embodiments, the water pump is an electric pump.

In some embodiments, a bottom of the upper bucket body is arranged with a rotation mechanism that upwardly protrudes.

In some embodiments, the upper bucket body comprises a cleaning container and a dumping container which are independent of each other and are blocked from each other.

In some embodiments, the cleaning container is located above the clean water container, and the dumping container is located above the sewage container.

In some embodiments, the dumping container comprises a water bearing portion enclosing a holding space and a water dumping basket disposed in the water bearing portion; a bottom of the water bearing portion is inclined toward the sewage container to guide water into the sewage container, and the bottom of the water bearing portion defines a plurality of water leakage holes.

In some embodiments, the drain port is disposed at a bottom of the cleaning container; the cleaning container comprises a drain valve for controlling opening and closing of the drain port.

In some embodiments, the water pump device is hung on an outer wall of the lower bucket body.

In some embodiments, the outlet of the water outlet pipe is located above the upper bucket body, and the water outlet pipe is rotatable.

In some embodiments, the lower bucket body further comprises a movable partition, and the clean water container and the sewage container is separated by the partition.

In some embodiments, a side wall of the clean water container is arranged with a clean water level observation portion, and a side wall of the sewage container is arranged with a sewage water level observation portion.

In some embodiments, a sewage discharge port is arranged at a bottom of a side wall of the sewage container, and a clean water discharge port is arranged at a bottom of a side wall of the clean water container.

In some embodiments, a plurality of wheels are arranged at a bottom of the lower bucket body, a drawbar is arranged at a side wall of the lower bucket body, and the upper bucket body comprises a carrying handle; the clean water and wastewater separating mop bucket further comprises a detergent dispensing portion.

Provided is a clean water and wastewater separating mop bucket, including: a lower bucket body and an upper bucket body movably disposed in the lower bucket body; wherein the lower bucket body comprises a clean water container and a sewage container that are independent of each other and are blocked from each other, and the upper bucket is provided with a drain port communicated with the sewage container; a water guide pipe, connecting the clean water container and the upper bucket body; wherein the water guide pipe comprises a water inlet pipe at least partly received in the clean water container and a water outlet pipe that is not directly connected to the water inlet pipe; and a water pump device, connected to the water guide pipe. With the use of the separated clean water container and the sewage container, as well as the water guide pipe and the water pump device for conveying the clean water, it can be ensured that the mop is cleaned with clean water every time, avoiding poor cleaning effect and secondary pollution caused by repeated use of sewage water for cleaning the mop.

BRIEF DESCRIPTION OF THE DRAWINGS

In order to more clearly illustrate the technical solutions in the specific embodiments or related art of the present disclosure, the accompanying drawings to be used in the description of the specific embodiments or related art will be briefly introduced below, and it will be obvious that the accompanying drawings in the following description are some of the embodiments of the present disclosure, and that for those skilled in the art, other drawings can be obtained on the basis of the accompanying drawings without putting in creative labor.

DETAILED DESCRIPTION

Figure 1:
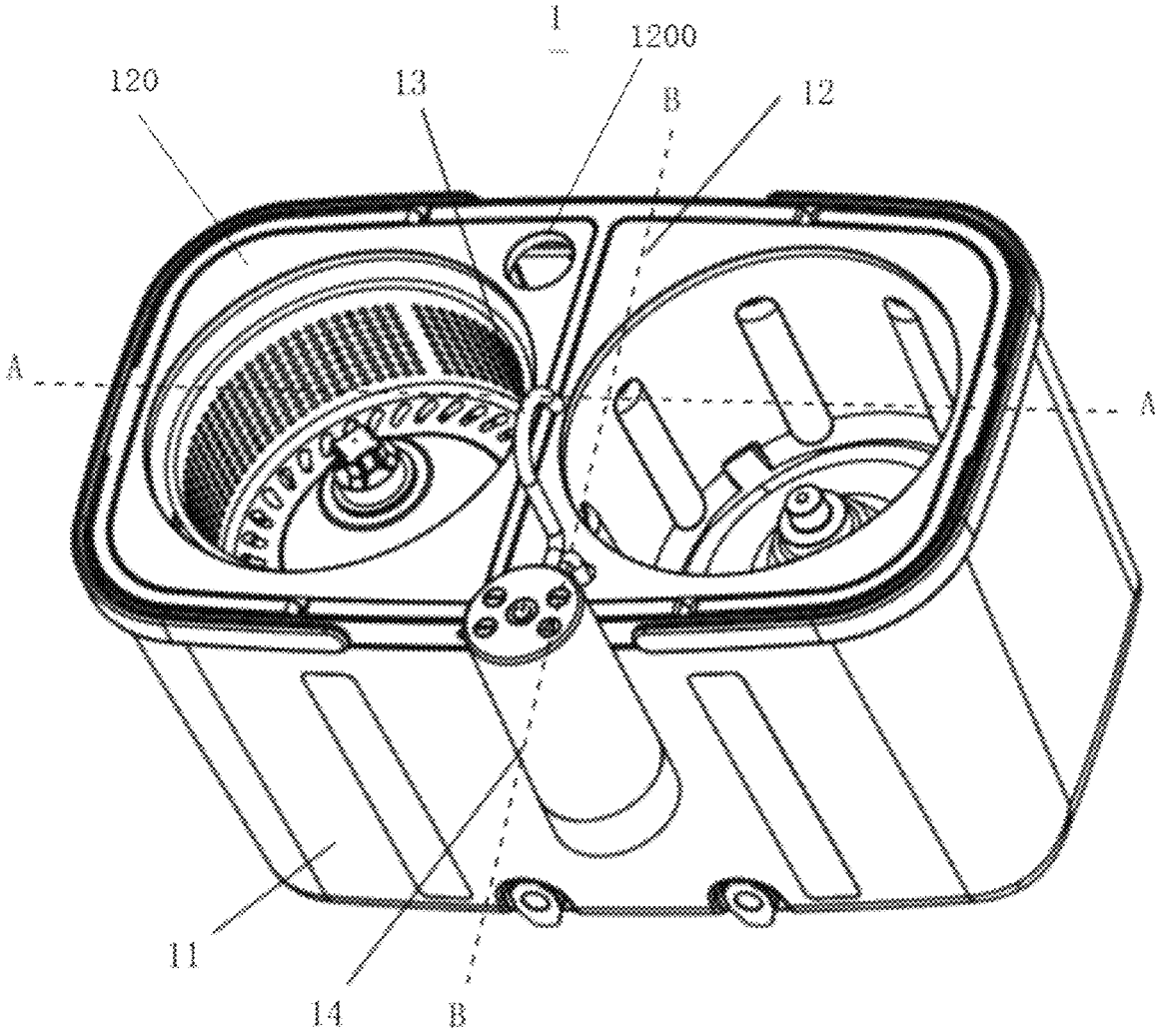
FIG. 1 is a schematic view of an assembled structure of a clean water and wastewater separating mop bucket according to an embodiment of the present disclosure.
Figure 2:
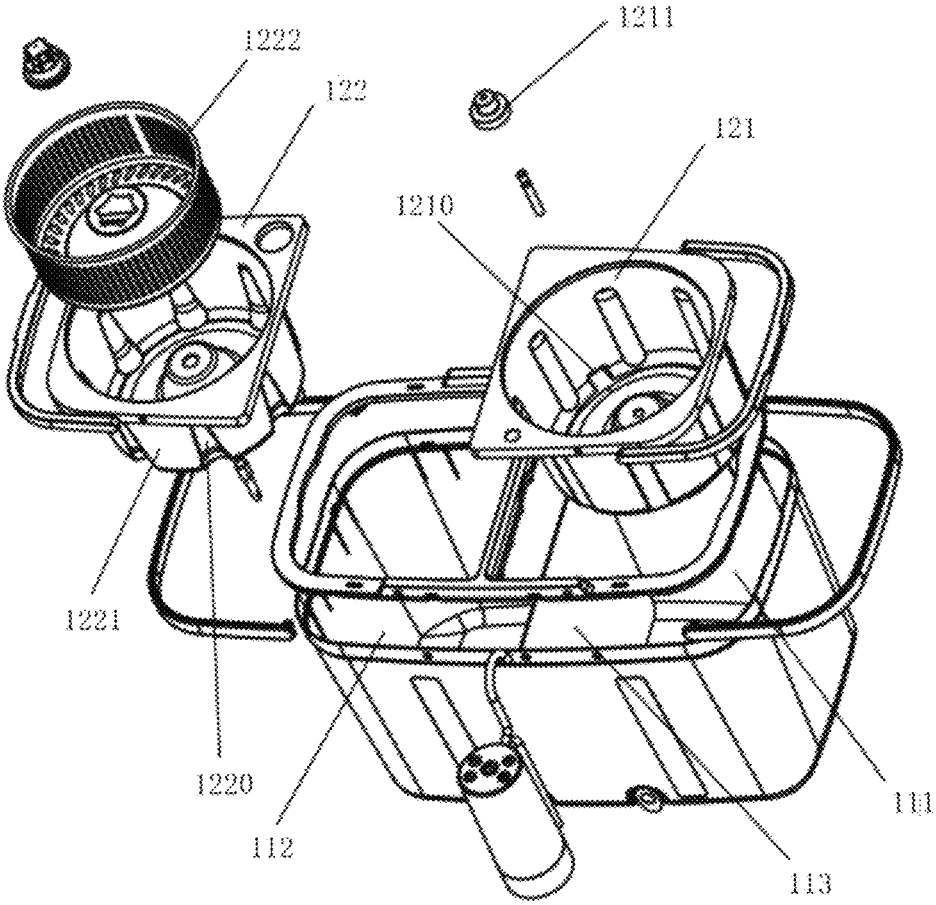
FIG. 2 is a schematic view of a disassembled structure of a clean water and wastewater separating mop bucket according to an embodiment of the present disclosure.
Figure 3:
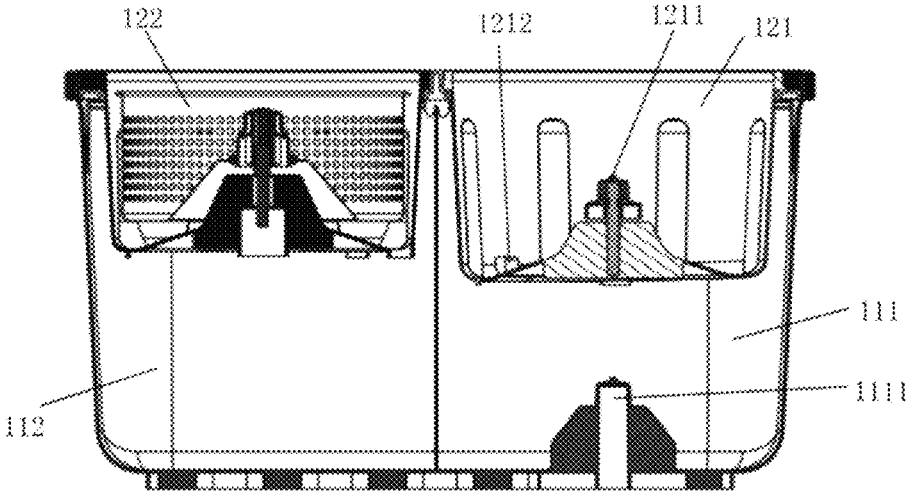
FIG. 3 is a cross-sectional view of the clean water and wastewater separating mop bucket shown in FIG. 1 along line A-A.
Figure 4:
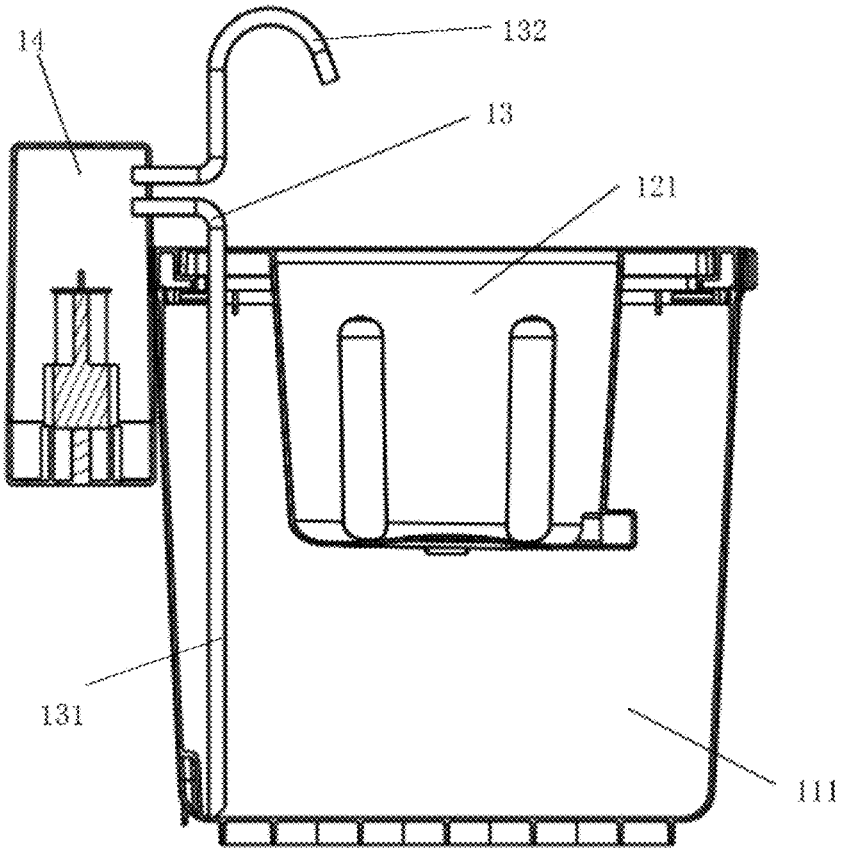
FIG. 4 is a cross-sectional view of the clean water and wastewater separating mop bucket shown in FIG. 1 along line B-B.

The technical solution of the present disclosure will be described clearly and completely in the following in conjunction with the accompanying drawings, and it is obvious that the described embodiments are a part of the embodiments of the present disclosure and not all of the embodiments. Based on the embodiments in the present disclosure, all other embodiments obtained by those skilled in the art without making creative labor fall within the scope of the present disclosure.

In the description of the present disclosure, it is to be noted that if terms "center", "up", "down", "left", "right", "vertical", "horizontal", "inside", "outside", etc. appear, the indicated orientation or positional relationship is based on the orientation or positional relationship shown in the accompanying drawings, only for the purpose of facilitating the description of the present disclosure and simplifying the description and not intended to indicate or imply that the device or element referred to must have a specific orientation, be constructed and operated with a specific orientation, and therefore are not to be construed as a limitation of the present disclosure. Furthermore, the terms "first", "second", "third", if present, are for descriptive purposes only and are not to be understood as indicating or implying relative importance.

Referring to FIGS. 1-4, the present disclosure provides a clean water and wastewater separating mop bucket 1 including a lower bucket body 11 and an upper bucket body 12 movably disposed in the lower bucket body 11; the lower bucket body 11 includes a clean water container 111 and a sewage container 112 which are independent of each other and are blocked from each other; the clean water and wastewater separating mop bucket 1 further includes a water guide pipe 13 connecting the clean water container 111 and the upper bucket body 12, and a water pump device 14 connected to the water guide pipe 13. By virtue of the water pump device 14 and the water guide pipe 13, clean water in the clean water container 111 can be pumped into the upper bucket body 12.

In the embodiments, the upper bucket body 12 includes a cleaning container 121 and a dumping container 122 which are independent of each other and are blocked from each other; the cleaning container 121 is disposed above the clean water container 111, the dumping container 122 is disposed above the sewage container 112, and the water guide pipe 13 is connected to the clean water container 111 and the cleaning container 121. A bottom of the cleaning container 121 is arranged with an upwardly protruding rotation mechanism 1211 and a drain port 1210 communicated with the sewage container 112, the drain port 1210 is arranged with a valve 1212. When the mop bucket is in use, the valve 1212 is closed, the water in the clean water container 111 is pumped into the cleaning container 121, and the mop is cleaned in the cleaning container 121; the water in the cleaning container 121 will become dirty, in which case the valve 1212 is opened and the sewage can be flowed into the sewage container 112 through the drain port 1210.

In some embodiments, the dumping container 122 includes a container body portion 1221 enclosing a holding space and a water dumping basket 1222 disposed within the container body portion 1221; the container body portion 1221 defines a water leakage hole 1220, such that the water thrown out from the water dumping basket 1222 is directly discharged through the water leakage hole 1220 into the sewage container 112 below the dumping container 122.

In the embodiments, the water pump device 14 is hung on an outer wall of the lower bucket body 11, specifically on a position of the clean water container 111 near the sewage container 112, and the water pump device 14 may be an electric pump.

As the water pump device 14 is an electric pump, the water guide pipe 13 can be divided into a water inlet pipe 131 and a water outlet pipe 132 that is not directly connected to the water inlet pipe 131. As long as the water inlet pipe 131 is at least partly received in the clean water container 111, and water in the clean water container 111 is able to flow into the upper bucket body 12 via the water outlet pipe 132, the electric pump 14 can achieve the purpose of pumping the clean water from the clean water tank 111 into the upper bucket body 12. Therefore, there are multiple options for the installation position of electric pump 14. As a replacement solution for the electric pump 14 hanging on the outer wall of the lower bucket body 11, the outer wall of the lower bucket body 11 can be provided with an electric pump containment compartment that protrudes in the direction away from the clean water container 111, so that the electric pump 14 stored in the electric pump storage compartment is not easy to fall off. In other embodiments, the electric pump containment tank can also protrude from the inner wall of the lower bucket body 11 towards the clean water container 111 and/or the sewage container 112. In this way, the overall shape of the clean water and wastewater separating mop bucket 1 is simple and beautiful without any protruding parts, but the volume of the clean water container 111 and/or the sewage container 112 will be relatively reduced. It is understood that the electric pump 14 can also be fixed on the upper cover 120 of the upper bucket body 12, for example, a containment hole 1200 that can partially accommodate the electric pump 14 is opened on the outer side of the cleaning container 121 and/or the water dumping basket 1222 of the dumping container 122.

In the present embodiment, the outlet of the water outlet pipe 132 is located above the upper bucket body 12, and the water outlet pipe 132 is rotatable, that is to say, the water flowing out from the water outlet pipe 132 can enter the container above the clean water container 111 or the container above the sewage container 112.

Due to the separation of the water inlet pipe 131 and the water outlet pipe 132 of the water guide pipe 13 of the clean water and wastewater separating mop bucket 1, and using the electric pump 14 to pump the water, the positions of the cleaning container 121 and the dumping container 122 can be flexibly adjusted. That is to say, the clean water and wastewater separating mop bucket 1 can be used when the cleaning container 121 is located above the clean water container 111, and the dumping container 122 is located above the sewage container 112, and also can be used when the cleaning container 121 is located above the the sewage container 112, and the dumping container 122 is located above clean water container 111.

In some embodiments, the lower bucket body 11 further includes a movable partition 113, and the clean water container 111 and the sewage container 112 is separated by the partition 113. The partition 113 may be removed when there is no need to separate the clean water from the sewage. In some embodiments, the partition 113 is arranged on a variable position such that the ratio of the clean water container 111 to the sewage container 112 can be adjusted.

In addition, a bottom of the clean water container 111 is arranged with a rotation mechanism 1111. Since the cleaning container 121 and the dumping container 122 can be detached from the lower bucket body 11 separately, the user can also remove the cleaning container 121 and directly clean the mop in the clean water container 111 before dumping it in the dumping container 122.

Figure 5:
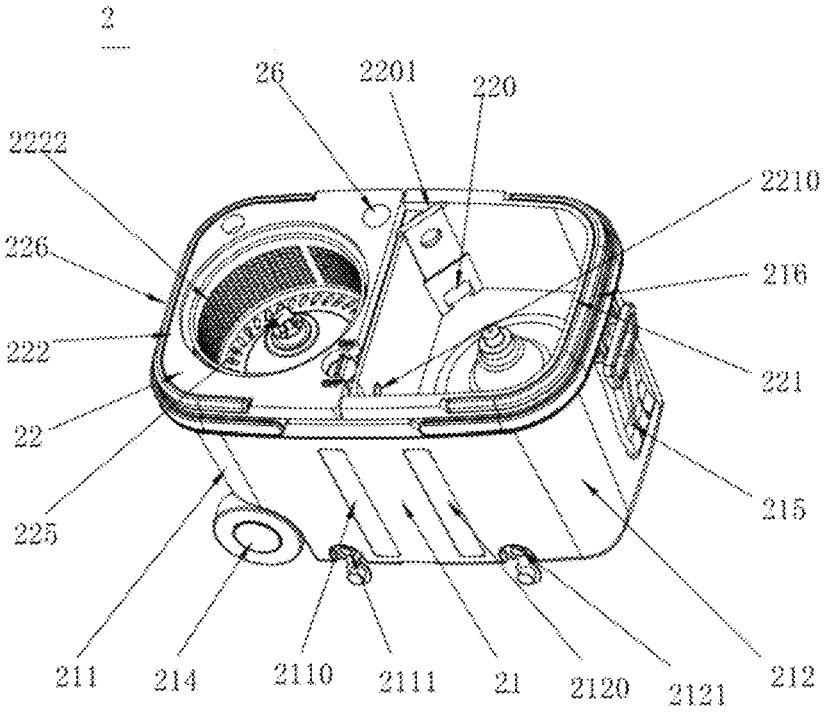
FIG. 5 is a schematic view of an assembled structure of a clean water and wastewater separating mop bucket according to another embodiment of the present disclosure.
Figure 6:
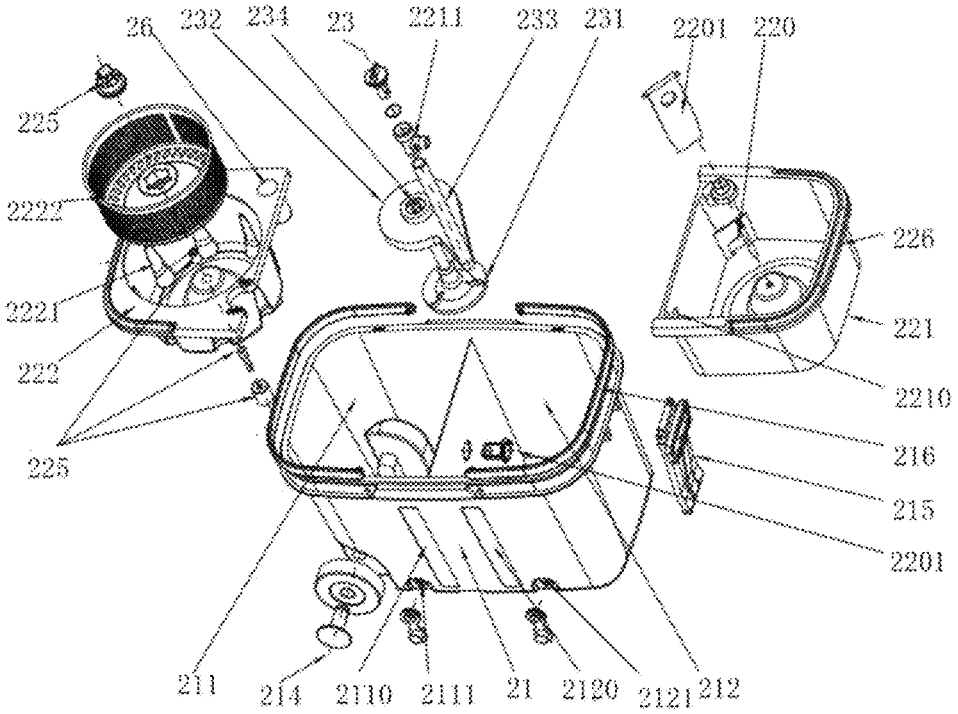
FIG. 6 is a schematic view of a disassembled structure of a clean water and wastewater separating mop bucket according to another embodiment of the present disclosure.
Figure 7:
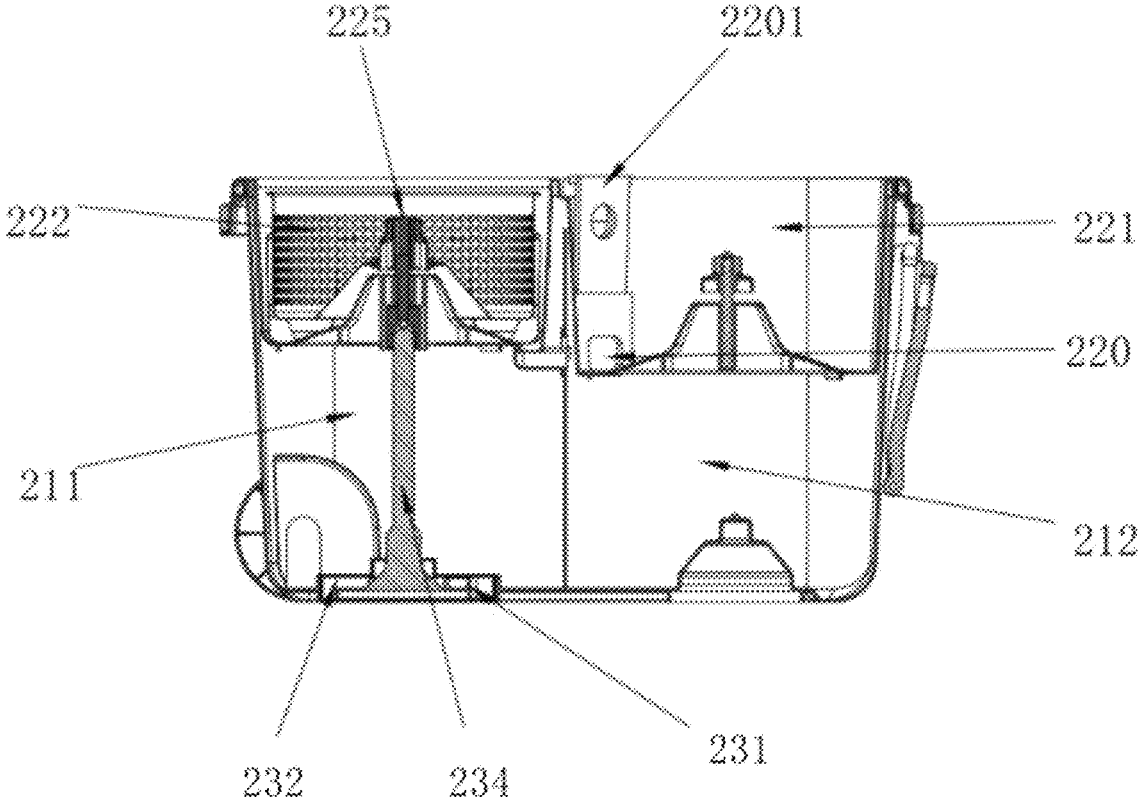
FIG. 7 is a cross-sectional view of the clean water and wastewater separating mop bucket shown in FIG. 5.

Referring to FIGS. 5-7, the present disclosure further provides a clean water and wastewater separating mop bucket 2, including a lower bucket body 21 and an upper bucket body 22 movably disposed in the lower bucket body 21; the lower bucket body 21 includes a clean water container 211 and a sewage container 212 which are independent of each other and are blocked from each other; a water pump device 23 is arranged within the clean water container 211 and is connected to the upper bucket body 22; a bottom of the upper bucket body 22 is arranged with an upwardly protruding rotation mechanism 225 and a drain port 220 communicated with the sewage container 212.

Specifically, the water pump device 23 includes a pump wheel 231 disposed at a bottom of the clean water container 211, a wheel cover 232 sleeved on the pump wheel 231 and defining a pumping space, and a rotor shaft 234 connecting the rotation mechanism 225 and the pump wheel 231. A water guide pipe 233 is connected to the pumping space and the upper bucket body 22. When the rotation mechanism 225 rotates, the pump wheel 231 is driven to rotate by the rotor shaft 234. There is a gap between the wheel cover 232 and the bottom of the clean water container 211, and clean water in the clean water container 211 enters the pumping space from the gap. When the pump wheel 231 rotates, the clean water in the pumping space is pumped into the water guide pipe 233, thereby enabling the clean water in the clean water container 211 to be pumped into the upper bucket body 22 disposed above the clean water container 211.

In the embodiments, the upper bucket body 22 includes a cleaning container 221 and a dumping container 222 which are independent of each other and blocked from each other; the cleaning container 221 is disposed above the sewage container 212, and the dumping container 222 is disposed above the clean water container 211. Specifically, the clean water and wastewater separating mop bucket 2 is rectangular in shape, and the clean water container 211 and the sewage container 212 are arranged in a left-right direction along a long side of the clean water and wastewater separating mop bucket 2 and separated by a partition in the middle. The cleaning container 221 and the dumping container 222 are respectively bowl-shaped and cover above the sewage container 212 and the clean water container 211, and the water guide pipe 233 is connected to the cleaning container 221.

In some embodiments, the dumping container 222 includes a water bearing portion 2221 enclosing a holding space and a water dumping basket 2222 disposed in the water bearing portion 2221; a bottom of the water bearing portion 2221 is inclined toward the sewage container 212 to guide the water thrown out during drying of the mop into the sewage container 212, and the water bearing portion 2221 may be arranged with a drain pipe to accurately direct the water into the sewage container 212.

The drain port 220 is disposed at a bottom of the cleaning container 221, the cleaning container 221 includes a drain valve 2201 for controlling opening and closing of the drain port 220, and a side wall of the cleaning container 221 near the clean water container 212 is arranged with a water inlet port 2210 and a water inlet valve 2211.

When the clean water and wastewater separating mop bucket 2 is in use for the first time, the drain valve 2201 and the water inlet valve 2211 can be closed first, clean water is received in the clean water container 211 and the cleaning container 221, the mop is wetted in the cleaning container 221 and then moved to the dumping container 222 to be dumped and dried, and the dumped water flows into the sewage container 212. After mopping the floor, the mop is cleaned in the cleaning container 221, and the water inside the cleaning container 221 will become dirty, in which case the drain valve 2201 can be opened to drain the sewage from the cleaning container 221 directly into the sewage container 212 below the cleaning container 221. After the sewage in the cleaning container 221 is discharged completely, the drain valve 2201 is closed and the water inlet valve 2211 is opened, and the mop is moved to the dumping container 222 to abut against the rotation mechanism 225 for rotation, in which case the rotation mechanism 225 drives the operation of the water pump device 23, and the clean water in the clean water container 211 flows into the cleaning container 221. In this way, the sewage in the cleaning container 221 is replaced with clean water, and the next time the mop is to be cleaned in the cleaning container 221, clean water is used for cleaning. It can be understood that since there is no accumulation of water in the dumping container 222 with less resistance, the rotation mechanism 225 rotates very fast and can quickly pump the clean water in the clean water container 211 into the cleaning container 221.

In some embodiments, a side wall of the clean water container 211 is arranged with a clean water level observation portion 2110, and a side wall of the sewage container 212 is arranged with a sewage water level observation portion 2120, which allow the user to timely determine whether it is necessary to replenish water to the clean water container 211 or empty the sewage container 212. A sewage discharge port 2121 is arranged at a bottom of the side wall of the sewage container 212, and a clean water discharge port 2111 is arranged at a bottom of the side wall of the clean water container 211, which facilitates the user to empty the sewage container 212 or the clean water container 211. Multiple wheels 214 are arranged at a bottom of the lower bucket body 21, and a drawbar 215 and a lower carrying handle 216 are arranged at a side wall of the lower bucket body 21, which facilitate the user to move the clean water and wastewater separating mop bucket 2. The upper bucket body 22 includes an upper carrying handle 226, specifically, the cleaning container 221 and the dumping container 222 are each arranged with the upper carrying handle 226, which facilitates the user in picking up the cleaning container 221 and the dumping container 222. The clean water and wastewater separating mop bucket 2 further includes a detergent dispensing portion 26, which may be a press-extruding detergent container fixed to the upper bucket body 22.

It is understood that in other embodiments, the sewage container may be disposed around the clean water container; the upper bucket body includes a cleaning and drying container disposed above the clean water container and a drainage portion disposed around the cleaning and drying container; a first valve is arranged between the cleaning and drying container and the drainage portion, a bottom of the drainage portion extends from a bottom of the cleaning and drying container and is inclined downward, the water guide pipe is connected to the cleaning and drying container, and a side wall of the cleaning and drying container is arranged with a second valve.

When the mop bucket is in use, the first valve is closed, and clean water is received in the cleaning and drying container. After mopping the floor, the mop is cleaned in the cleaning and drying container, and the water in the cleaning and drying container will become dirty, in which case the first valve can be opened to drain the sewage from the cleaning and drying container into the drainage portion; the drainage portion is connected to the sewage container, and the sewage flows into the sewage container directly along the inclined bottom surface of the drainage portion. After the sewage in the cleaning and drying container is discharged completely, the first valve is kept open, and then the mop is rotated for drying, and the water thrown out also flows into the sewage container through the drainage portion. When the mop is required to be cleaned for the next time, the second valve is opened, the mop is put into the cleaning and drying container and abuts against the rotation mechanism for rotation, in which case the rotation mechanism drives the water pump device to operate, and the water in the clean water container flows into the cleaning and drying container. In this way, the water for cleaning the mop for the next time is clean water.

Figure 8:
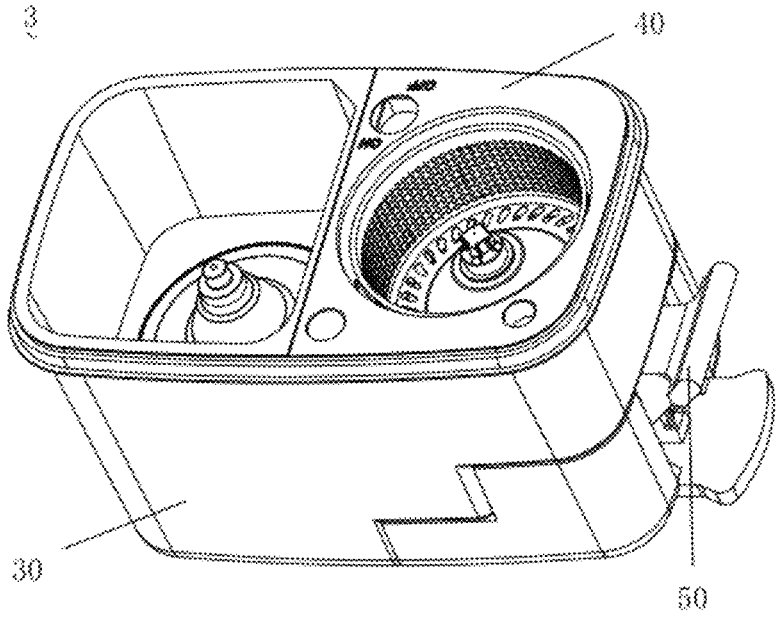
FIG. 8 is a schematic view of an assembled structure of a clean water and wastewater separating mop bucket according to further another embodiment of the present disclosure.
Figure 9:
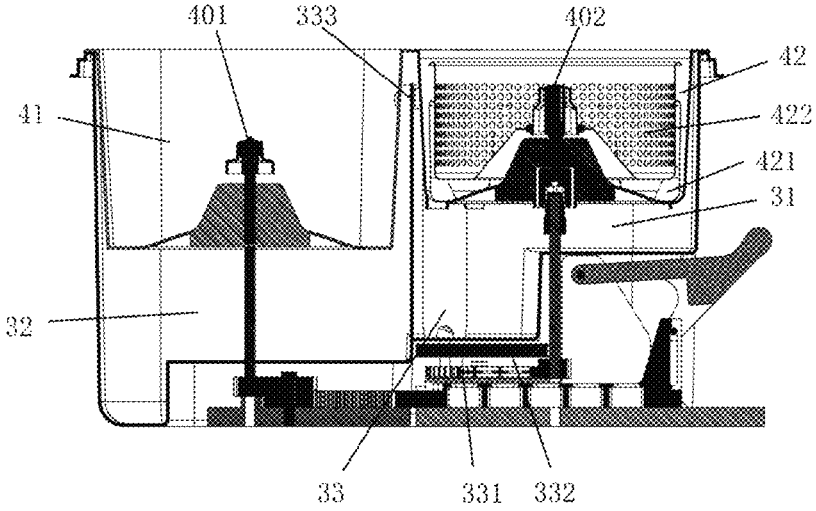
FIG. 9 is a schematic view of a disassembled structure of a clean water and wastewater separating mop bucket according to further another embodiment of the present disclosure.
Figure 10:
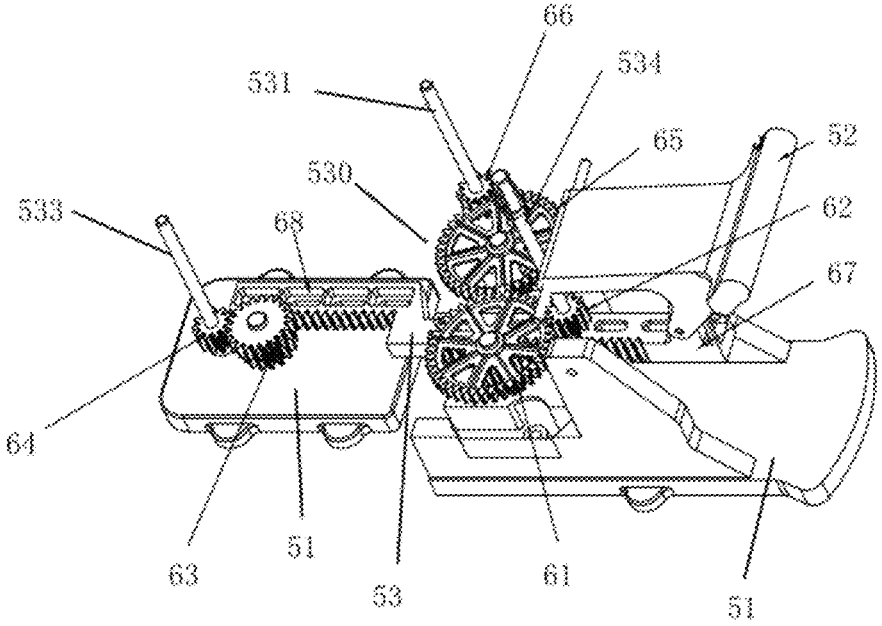
FIG. 10 is a schematic view of a disassembled structure of a drive device of a clean water and wastewater separating mop bucket according to further another embodiment of the present disclosure.

Referring to FIGS. 8-10, the present disclosure further provides a clean water and wastewater separating mop bucket 3, including a lower bucket body 30 and an upper bucket body 40 movably disposed in the lower bucket body 30, and a drive device 50 disposed at a bottom of the lower bucket body 30. Specifically, a notch is arranged at the bottom of the lower bucket body 30, and the drive device 50 is received in the notch.

In the embodiments, the lower bucket body 30 includes a clean water container 31 and a sewage container 32 which are independent of each other and blocked from each other, and the upper bucket body 40 includes a cleaning container 41 and a dumping container 42 which are independent of each other and blocked from each other; the cleaning container 41 is disposed above the sewage container 32, and the dumping container 42 is disposed above the clean water container 31; a water pump device 33 is arranged in the clean water container 31 and is connected to the cleaning container 41; a bottom of the cleaning container 41 is arranged with an upwardly protruding cleaning container rotation mechanism 401 and a drainage port communicated with the sewage container 32; the dumping container 42 includes a water bearing portion 421 enclosing a holding space, a water dumping basket 422 disposed in the water bearing portion 421, and a dumping container rotation mechanism 402 which protrudes upwardly from a bottom of the water bearing portion 421 and is connected to the water dumping basket 422.

The water pump device 33 includes a pump wheel 331 disposed at a bottom of the clean water container 31, a wheel cover 332 sleeved on the pump wheel 331 and defining a pumping space, and a water guide pipe 333 connecting the pumping space and the cleaning container 41.

The drive device 50 includes a base plate 51, a pedal 52 disposed above the base plate 51, and a transmission mechanism 53 disposed on an upper surface of the base plate 51. The transmission mechanism 53 includes a water pump device transmission shaft 531 connected to the pump wheel 331, a cleaning container transmission shaft 533 connected to the cleaning container rotation mechanism 401, a dumping container transmission shaft 534 connected to the dumping container rotation mechanism 402, and a gear train 530 connected to the pump device transmission shaft 531, the cleaning container transmission shaft 533, and the dumping container transmission shaft 534.

Specifically, the gear train 530 includes a first rack 67 disposed below the clean water container 31, a second rack 68 disposed below the sewage container 32, a first gear 61 and a fifth gear 65 engaged with the first rack 67, a third gear 63 engaged with the second rack 68, a second gear 62 connected to the dumping container transmission shaft 534 and engaged with the first gear 61, a fourth gear 64 connected to the cleaning container transmission shaft 533 and engaged with the third gear 63, and a sixth gear 66 connected to the water pump device transmission shaft 531 and engaged with the fifth gear 65.

When the mop bucket is in use, the user steps on the pedal; based on the principle of the linkage mechanism, the first rack 67 and the second rack 68 reciprocate in the direction of the toe, and the linear motion of the rack is converted into the rotational motion of the gear engaged with the rack, i.e., the first gear 61, the third gear 63, and the fifth gear 65 rotate, which then drives the second gear 62, the fourth gear 64, and the sixth gear 66 to rotate, such that the dumping container transmission shaft 534, the cleaning container transmission shaft 533, and the water pump device transmission shaft 531 are also driven to rotate.

There is a gap between the wheel cover 332 and the bottom of the clean water container 31, and clean water in the clean water container 31 enters the pumping space from the gap. When the pump wheel 331 is driven to rotate by the water pump device transmission shaft 531, the clean water in the pumping space is pumped into the water guide pipe 333, thereby enabling the clean water in the clean water container 31 to be pumped to the cleaning container 41 disposed diagonally above the clean water container 31.

At the same time, the cleaning container rotation mechanism 401 and the dumping container rotation mechanism 402 also rotate such that the user can clean the mop in the cleaning container 41 or dump the mop in the dumping container 42.

In some embodiments, the second gear 62, the fourth gear 64, and the sixth gear 66 are each arranged with a one-way bearing internally, and the rotational work of the cleaning container rotation mechanism 401, the dumping container rotation mechanism 402, and the pump wheel 331 can be realized either by stepping on the pedal, or by the user pressing the mop lever back and forth directly on the dumping container rotation mechanism 402.

The clean water and wastewater separating mop bucket provided by the present disclosure includes a lower bucket body and an upper bucket body movably disposed in the lower bucket body, the lower bucket body including a clean water container and a sewage container which are independent of each other and are blocked off; the clean water and wastewater separating mop bucket further includes a water guide pipe connecting the clean water container and the upper bucket body, and a pump device connected to the water guide pipe. With the use of the separated clean water container and the sewage container, as well as the water guide pipe and the water pump device for conveying the clean water, it can be ensured that the mop is cleaned with clean water every time, avoiding poor cleaning effect and secondary pollution caused by repeated use of sewage water for cleaning the mop.

The above embodiments are only intended to illustrate the technical solution of the present disclosure, but not to limit it; although the present disclosure has been described in detail with reference to the foregoing embodiments, those skilled in the art should understand that it is still possible to modify the technical solution recorded in the foregoing embodiments, or to replace some or all of the technical features therein with equivalent ones; and these modifications or substitutions do not take the essence of the corresponding technical solutions out of the scope of the technical solutions of the embodiments of the present disclosure.

What is claimed is:

1. A clean water and wastewater separating mop bucket, comprising:

a lower bucket body, wherein the lower bucket body comprises a clean water container and a sewage container that are independent of each other and are blocked from each other an upper bucket body movably disposed in the lower bucket body, wherein the upper bucket body comprises a cleaning container and a dumping container which are independent of each other and are blocked from each other, the cleaning container is located above the clean water container, the dumping container is located above the sewage container, a bottom of the cleaning container is provided with a drain port communicated with the sewage container, and the cleaning container comprises a drain valve for controlling opening and closing of the drain port;

a water guide pipe, connecting the clean water container and the upper bucket body; wherein the water guide pipe comprises a water inlet pipe at least partly received in the clean water container and a water outlet pipe that is not directly connected to the water inlet pipe; and a water pump device, connected to the water guide pipe; wherein the water pump device is hung on an outer wall of the lower bucket body.

2. The mop bucket according to claim 1, wherein the water pump device is an electric pump.

3. The mop bucket according to claim 1, wherein a bottom of the upper bucket body is arranged with a rotation mechanism that upwardly protrudes.

4. The mop bucket according to claim 1, wherein an outlet of the water outlet pipe is located above the upper bucket body, and the water outlet pipe is rotatable.

5. The mop bucket according to claim 1, wherein the lower bucket body further comprises a movable partition, and the clean water container and the sewage container are separated from each other by the partition.

* * * * *